US010401055B2

(12) United States Patent
Kraft et al.

(10) Patent No.: US 10,401,055 B2
(45) Date of Patent: Sep. 3, 2019

(54) REDUCED DRAG COMBUSTION PASS IN A TUBULAR HEAT EXCHANGER

(71) Applicant: TRANE INTERNATIONAL INC., Davidson, NC (US)

(72) Inventors: Wayne N. Kraft, Tyler, TX (US); Nathan Wagers, Henderson, TX (US); Dennis Scott Bradbury, Tyler, TX (US); Joshua Brian Coley, Tyler, TX (US); Sandeep Gowdagiri, Tyler, TX (US)

(73) Assignee: TRANE INTERNATIONAL INC., Davidson, NC (US)

( * ) Notice: Subject to any disclaimer, the term of this patent is extended or adjusted under 35 U.S.C. 154(b) by 202 days.

(21) Appl. No.: 15/449,733

(22) Filed: Mar. 3, 2017

(65) Prior Publication Data

US 2018/0252433 A1 Sep. 6, 2018

(51) Int. Cl.

| | |
|---|---|
| ***F24D 5/02*** | (2006.01) |
| ***F24D 19/00*** | (2006.01) |
| ***F24H 9/00*** | (2006.01) |
| ***F24H 3/08*** | (2006.01) |
| ***F28F 1/06*** | (2006.01) |

(Continued)

(52) U.S. Cl.

CPC ..... *F24H 3/087* (2013.01); *F24D 5/02* (2013.01); *F24D 19/00* (2013.01); *F24H 9/0068* (2013.01); *F24H 9/1881* (2013.01); *F28D 7/085* (2013.01); *F28F 1/06* (2013.01); *F28F 1/08* (2013.01); *F28F 13/02* (2013.01);

(Continued)

(58) Field of Classification Search

CPC ..... F24H 3/087; F24H 9/0068; F24H 9/00; F28F 1/06; F28F 1/006; F28F 1/10; F28F 13/08; F24D 2220/06; F24D 5/02; F24D 19/00; F24F 1/06; F24F 1/10

USPC ..... 126/112, 109, 99 A; 165/50, 145, 150

See application file for complete search history.

(56) References Cited

U.S. PATENT DOCUMENTS 514,338 A 2/1894 Row
586,062 A * 7/1897 Rice ..... F24H 3/00 126/109

(Continued)

FOREIGN PATENT DOCUMENTS

DE 3644287 A1 * 7/1988 ..... F24H 3/065
JP 2006349212 A * 12/2006

(Continued)

OTHER PUBLICATIONS

U.S. Appl. No. 15/296,893, filed Oct. 18, 2016 (35 pages).

*Primary Examiner* — Gregory L Huson
*Assistant Examiner* — Daniel E Namay
(74) *Attorney, Agent, or Firm* — Hamre, Schumann, Mueller & Larson, P.C.

(57) ABSTRACT

A heat exchanger tube includes a first pass for at least partially combusting a fuel and the first pass having a modified shape including a minor diameter and major diameter that reduces the external pressure drop of an external fluid flowing across the heat exchanger tube. A HVACR system includes a heat exchanger tube with a first heat exchange pass that at least partially combusts a fuel and has a modified shape. A method of making a heat exchanger including configuring a first heat exchange pass such that the major diameter of modified portion of the first heat exchange pass is oriented towards an incoming direction of the process fluid.

20 Claims, 7 Drawing Sheets

(51) Int. Cl.

| | |
|---|---|
| ***F28F 13/02*** | (2006.01) |
| ***F24H 9/18*** | (2006.01) |
| ***F28D 7/08*** | (2006.01) |
| ***F28F 1/08*** | (2006.01) |
| *F24F 1/06* | (2011.01) |
| *F24F 1/10* | (2011.01) |
| *F28F 13/08* | (2006.01) |

(52) U.S. Cl.
CPC ..... *F24D 2200/04* (2013.01); *F24D 2220/06* (2013.01); *F24H 2210/00* (2013.01)

(56) References Cited

U.S. PATENT DOCUMENTS

| | | | | | |
|---|---|---|---|---|---|
| 601,590 | A * | 3/1898 | Rossman | F24B 7/025 | 126/61 |
| 1,919,164 | A * | 7/1933 | Jerome | F22B 33/04 | 122/135.3 |
| 1,922,838 | A | 8/1933 | Bossart | | |
| 4,776,320 | A * | 10/1988 | Ripka | F23M 9/06 | 126/109 |
| 4,844,153 | A * | 7/1989 | Mellsjo | F28D 7/026 | 165/174 |
| 5,094,224 | A | 3/1992 | Diesch | | |
| 5,271,376 | A | 12/1993 | Lu et al. | | |
| 5,505,252 | A * | 4/1996 | Mano | F24H 3/065 | 126/99 A |
| 5,649,529 | A * | 7/1997 | Lu | F23M 9/06 | 126/110 R |
| RE37,009 | E | 1/2001 | Diesch | | |
| 6,688,378 | B2 | 2/2004 | O'Donnell et al. | | |
| 6,945,320 | B2 | 9/2005 | Harvard, Jr. et al. | | |
| 7,255,155 | B2 | 8/2007 | O'Donnell et al. | | |
| 8,844,472 | B2 | 9/2014 | Smelcer et al. | | |
| 8,985,999 | B2 | 3/2015 | Sherrow et al. | | |
| 9,476,656 | B2 | 10/2016 | Anwar et al. | | |
| 9,709,341 | B2 * | 7/2017 | Naruse | F24H 8/00 | |
| 2002/0005275 | A1 * | 1/2002 | O'Donnell | F24H 9/0026 | 165/109.1 |
| 2005/0161209 | A1 | 9/2005 | Havard et al. | | |
| 2010/0294474 | A1 | 11/2010 | Hirota | | |
| 2011/0297139 | A1 * | 12/2011 | Tsunekawa | F28F 17/005 | 126/112 |
| 2012/0006512 | A1 | 1/2012 | Guo et al. | | |
| 2016/0131395 | A1 * | 5/2016 | Wagers | F24H 3/087 | 126/99 D |
| 2016/0131397 | A1 * | 5/2016 | Wagers | F24H 9/0068 | 126/99 D |
| 2018/0023895 | A1 * | 1/2018 | Kraft | F28D 1/0478 | 165/109.1 |
| 2018/0106500 | A1 * | 4/2018 | Kraft | F24H 3/08 | |

FOREIGN PATENT DOCUMENTS

| | | | | |
|---|---|---|---|---|
| JP | 2012002495 | A * | 1/2012 | F28D 7/106 |
| JP | 2015010757 | A * | 1/2015 | |
| JP | 2018044707 | A * | 3/2018 | |

* cited by examiner

REDUCED DRAG COMBUSTION PASS IN A TUBULAR HEAT EXCHANGER

FIELD

This disclosure relates to heat exchanger tubes for a heat exchanger in a heating, ventilation, air conditioning, and refrigeration ("HVACR") system.

BACKGROUND

HVACR systems can include furnaces for heating air. The HVACR system may then heat a building (e.g., residential home, commercial building, office building, etc.) by transferring the heated air to different locations throughout the building. A heat source for the HVACR system may be the combustion reaction of a fuel (e.g., natural gas, etc.). In such a system, the hot and harmful combustion gases may flow through a heat exchanger tube and the process fluid (e.g., air, etc.) may be heated as it flows over the outside surface of the heat exchange tube. A HVACR system may employ a multi-pass heat exchanger to transfer the heat from the hot combustion products to the air. The multi-pass heat exchanger may provide a heat exchanger tube having two or more passes through the heat exchange volume of the heat exchanger (e.g., multi-pass).

SUMMARY

A HVACR system can have a furnace that utilizes a heat exchanger with a multi-pass passageway. A dimension across the passageway from part of its interior surface to another part of its interior surface through a center point may be defined as its diameter. The passageway can have a tubular structure that includes a first heat exchange pass for at least the partial combustion of a fuel. In many embodiments, a majority of the combustion occurs within the first heat exchange pass. A length of the first heat exchange pass may be modified and configured to provide a reduced external pressure drop. A length of a first heat exchange pass can be modified such that the shape of the cross-section does not have a constant diameter. In comparison, a circular tube would have a constant diameter. An axis along the smallest diameter in a cross section of the modified first heat exchange pass can be defined as its minor axis and the smallest diameter may be defined as the minor diameter. An axis along the largest diameter in a cross section of the modified first heat exchange pass can be defined as its major axis and the largest diameter may be defined as its major diameter. In some embodiments, the first heat exchange pass has a major surface and a minor surface. A minor surface is a surface of the first heat exchange pass that extends along the direction of the minor axis and the major surface is surface of the first heat exchange pass that extends along the direction of the major axis. The first heat exchange pass may be configured so that its major axis is oriented towards a direction of an incoming process fluid (e.g., air to be heated, etc.), such that the first heat exchange pass presents a streamlined shape for the process fluid to flow over.

In an embodiment, a heat exchanger tube may have a first heat exchange pass and one or more subsequent heat exchange passes. The first heat exchange pass may be configured to contain at least a majority of the combustion of a fuel. Each heat exchange pass may be fluidly connected to a subsequent heat exchange pass by a bend. The first heat exchange pass includes an inlet and one of the one or more subsequent heat exchange passes includes an outlet. The first heat exchange pass includes a modified portion shaped to have cross-section with a major diameter and a minor diameter.

In an embodiment, a HVACR system for heating air has a heat exchanger space, a heat exchanger tube, and a fan for blowing air into the heat exchanger space and towards the heat exchanger tube. The heat exchanger tube has a first heat exchange pass and at least one or more subsequent heat exchange passes. While in operation, at least a majority of a fuel is combusted within the first heat exchange pass. A length of the first heat exchange pass may be shaped to have a cross-section with a minor diameter and a major diameter. The first heat exchange pass can be configured within the heat exchanger space such that the major diameter of the length of the first heat exchange pass is oriented towards the incoming air.

In an embodiment, a method of making a heat exchanger is described. The method includes constructing a heat exchanger housing with a heat exchanger volume. The method includes providing a heat exchanger tube with two or more heat exchange passes inside the heat exchanger volume. A process fluid flows through the heat exchanger volume. The two or more heat exchange passes including a first heat exchange pass with a tube inlet. The first heat exchange pass may be constructed for combusting a majority of an internal fluid. The first heat exchange pass is also constructed to have a length with a minor diameter and a major diameter. The method may include configuring the heat exchanger tube within the heat exchanger volume such that major diameter of the first heat exchange pass is oriented towards the direction of the incoming flowing process fluid.

BRIEF DESCRIPTION OF THE DRAWINGS

Both described and other features, aspects, and advantages of a heat exchanger and heat exchanger tube will be better understood with the following drawings.

DETAILED DESCRIPTION

Figure 1:
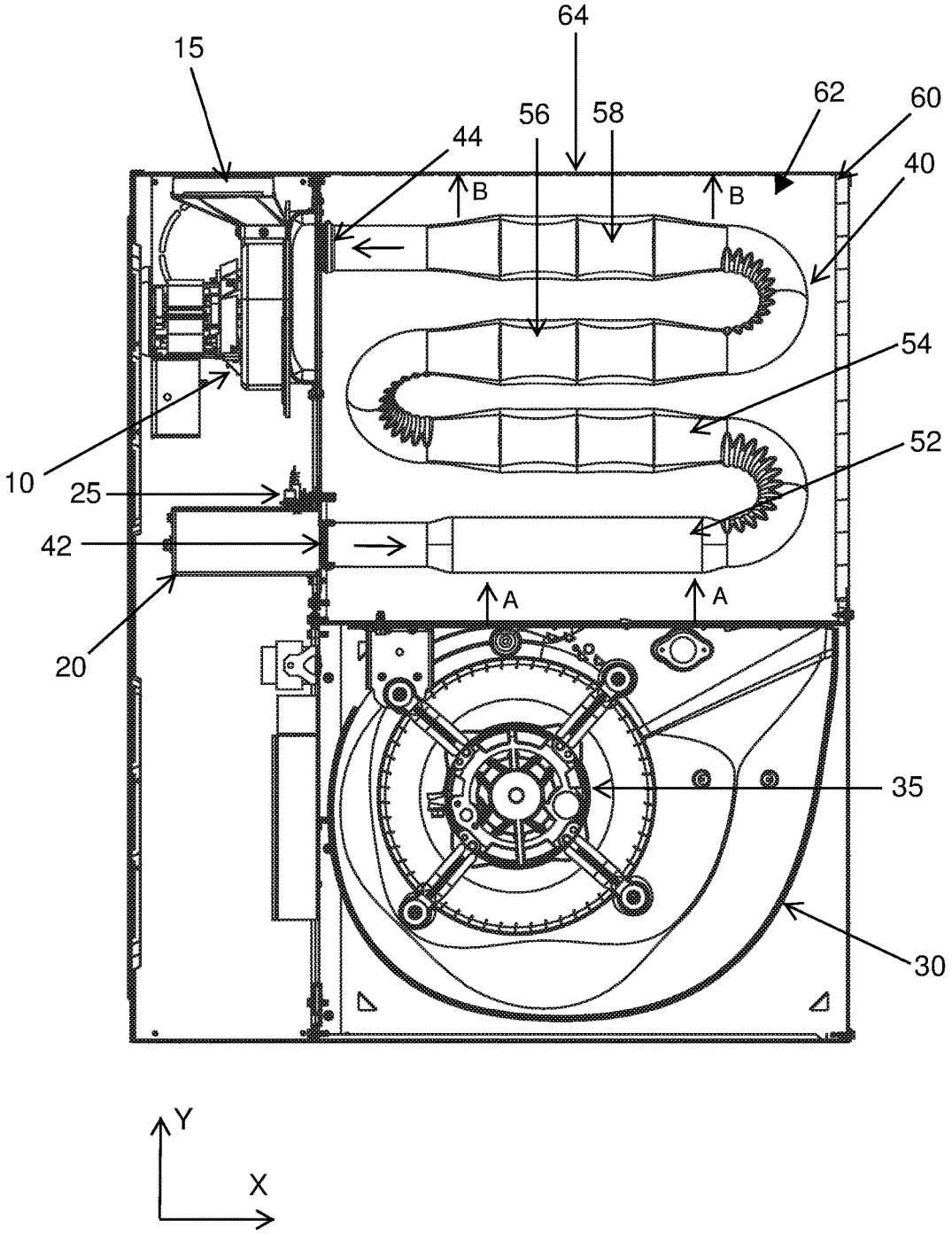
FIG. 1 shows a schematic diagram of an embodiment of a furnace that includes a heat exchanger tube.

A furnace may include a furnace cabinet with a heat exchanger portion. The heat exchanger portion may have a heat exchanger volume for heating air. One or more heat exchanger tubes may be located within the heat exchanger volume. The furnace cabinet may include a device, such as a fan or blower, to push a process fluid, such as air, through the heat exchanger volume and past the surfaces of the heat exchanger tube. When flowing air contacts the surface of the heat exchanger tube, the air is heated by the hot heat exchanger tube. The furnace may employ a combustible gaseous fuel (e.g., natural gas, etc.) as a heat source. In some furnaces, a burner is provided to supply an air and fuel mixture into a first pass of the heat exchanger. Before the fuel and air mixture enters the first heat exchange pass, an ignition source is provided for starting the combustion reaction of the fuel and air mixture. A majority, if not all, of the combustion reaction may occur in the first heat exchange pass. Combustion of a fuel in multiple passes is generally less efficient. However, some embodiments may utilize multiple heat exchange passes due to various design factors. For example, combustion may occur in more than one pass in embodiments utilizing a larger amount of fuel or having a constrained width for the heat exchanger portion. The air and fuel mixture combusts to form hot combustion gases.

As combustion occurs in the first heat exchange pass, previous heat exchangers would avoid changing the shape of the first heat exchange pass as a non-circular first heat exchange pass may create or increase the chance of flame impingement, negatively affect the upstream mixing of fuel and air, or both. A first heat exchange passage having a circular cross-section creates a low free area ratio within the heat exchanger and a corresponding large external pressure drop across the heat exchanger tube. This pressure drop can be especially large when the heat exchanger has a parallel flow configuration in which the first heat exchange pass is located directly in front of the outlet of a blower; the blower providing and blowing the air through the heat exchanger volume and around the heat exchanger tube. This pressure drop requires the blower to use more power to provide the required amount of air through the heat exchanger volume. The larger amount of required power can negatively impact the overall efficiency of the furnace.

Embodiments described in this specification include a multi-pass heat exchanger tube in a heat exchanger having a modification to a length of the first heat exchange pass. This modified portion has been modified so that its cross-section has a varying diameter. As the modified portion has a varying diameter, the modified portion has a minor diameter and a major diameter with a corresponding major axis and minor axis. The first heat exchange pass may be configured such that the major diameter of the modified length or portion is oriented towards a direction of the incoming process fluid (e.g., air, etc.). In an embodiment, a fuel and air mixture is provided into the first heat exchange pass and at least a majority of the combustion of the fuel and air mixture occurs within the first heat exchange pass. In an embodiment, the heat exchanger tube may include four heat exchange passes. Each heat exchange pass may have a modified portion or length. A part or the entirety of a heat exchange pass may be modified. An embodiment may modify the lengths or portions of each heat exchange pass similarly or differently. The shape of a modified length of a heat exchange pass may be utilized to provide an advantageous streamlined shape that has a reduced external pressure drop without significantly impacting the internal pressure drop or internal combustion of a heat exchange pass. Embodiments with the described modified first heat exchange pass have been shown to have a reduced power requirement for the blower of at or about 5% to 10% over previous heat exchangers and previous heat exchanger tubes.

FIG. 1 shows an embodiment of a furnace including a heat exchanger tube 40. The furnace includes an exhaust system 10, a burner 20, a blower 30, and a heat exchanger 60. The heat exchanger 60 includes a heat exchange volume 62 where flowing air is heated by the hot combustion gases flowing through the heat exchanger tube 40. The heat exchanger 60 is configured so that air enters the heat exchange volume 62 from the blower 30 and air leaves the heat exchange volume by way of an air outlet 64. Air is blown into the heat exchange volume 62 from the blower 30 as shown by the arrows A. The air then passes over and around the heat exchange passes 52, 54, 56, 58 of the heat exchanger tube 40 and exits the heat exchange volume 62 through the air outlet 64 as shown by arrows B. As air passes the surface of the heat exchanger tube 40, the air is heated as it absorbs heat from the surface of the heat exchanger tube 40. The hot combustion gases heat the inner surface of the heat exchanger tube 40 as they travel through the heat exchanger tube 40. In such a manner, the heat exchanger tube 40 allows for the heat of the combustion gases to be transferred to the air without mixing the combustion gases and the air. In an embodiment, the heated air leaves the heat exchange volume 62 through the air outlet 64 and enters a duct (not shown). The duct then transfers the hot air throughout a building. The heat exchanger tube 40 shown in FIG. 1 includes four heat exchange passes 52, 54, 56, 58, but other embodiments of a heat exchanger tube 40 may have two or more passes. The furnace is shown having a single heat exchanger tube 40, but other embodiments of a furnace may include multiple heat exchanger tubes 40, for example, in parallel. Some of such embodiments may include additional burners 20, exhaust systems 10, or both for each additional heat exchanger tube 40 as may be suitable.

The heat exchanger tube 40 has a tube inlet 42 and a tube outlet 44. The heat exchanger tube 40 includes four heat exchange passes 52, 54, 56, 58. Embodiments of the heat exchange passes 52, 54, 56, 58 are described in more detail below. The burner 20 is provided at tube inlet 42. The burner 20 is connected to the heat exchanger inlet 42. The burner 20 may also include an ignitor 25 for igniting a fuel and air mixture. When the furnace is in operation, the burner 20 provides a fuel and air mixture into the heat exchanger tube 40 through the tube inlet 42. Before entering the heat exchanger tube 40, the ignitor 25 ignites the fuel and air mixture. Accordingly, the fuel and air mixture starts to combust as it enters the heat exchanger tube 40. In the furnace shown in FIG. 1, a majority of the combustion of the fuel and air mixture occurs within the first heat exchange pass 52 of the heat exchanger tube 40. As the fuel and air mixture combusts, the combustion produces hot combustion gases that can heat the heat exchange tube 40 to then heat the air flowing around the outside surface of the heat exchange tube 40.

An exhaust system 10 is provided at the tube outlet 44. The exhaust system 10 blows the combustion gases into an exhaust vent 15. In an embodiment, the exhaust vent 15 may be a vent to an outside location or to a secondary heat exchanger. In some embodiments, the exhaust system 10 may also be configured to provide a suction pressure that controls the flow of combustion gases, air and fuel mixture, or both through the heat exchanger tube 40.

The furnace also includes a blower 30 with an electrical motor 35. The blower pulls air from outside of the furnace and blows it into and through the heat exchange volume 62. As described above, the air then passes over the heat exchange passes 52, 54, 56, 58 and exits through the air outlet 64. The blower 30 shown in FIG. 1 is a centrifugal fan, but other types of blowers or fans may be used (e.g., cross-flow fan, axial flow fan, etc.).

The furnace shown in FIG. 1 employs a heat exchanger utilizing a parallel flow configuration as the air and fuel mixture and combustion gases flow through the heat exchanger tube 40 in the same direction as the flowing air. However, other embodiments of the furnace may employ a counter-flow heat exchanger. In such embodiments, the exhaust fan 10 and burner 20 would be switched and the heat exchanger tube 40 flipped in the Y direction such that tube inlet 42 is still connected to the burner 20 and the tube outlet 44 is still connected to the exhaust fan 10. In a counter-flow heat exchanger, the air and fuel mixture and the combustion gases flow in the opposite direction of the flowing air. In an embodiment, the heat exchanger in FIG. 1 may also be configured as counter-flow heat exchanger if the blower 30 and air outlet 64 were configured to be in the opposite positions, such that the air flows through the heat exchange volume 62 in the opposite direction by entering in a direction opposite the arrows B and exiting in a direction opposite the arrows A.

Figure 2:
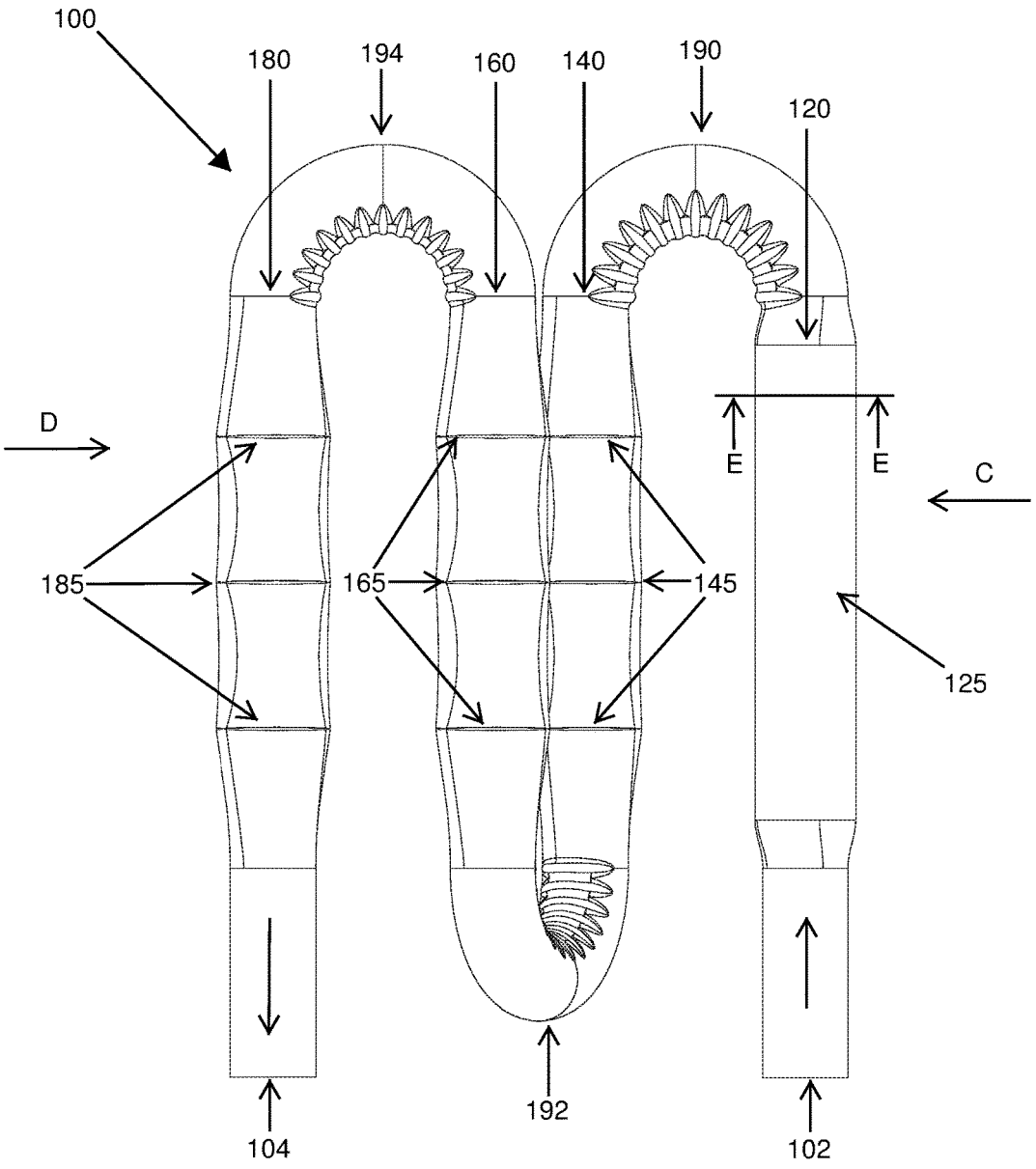
FIG. 2 shows an embodiment of a heat exchanger tube having four heat exchange passes.
Figure 3:
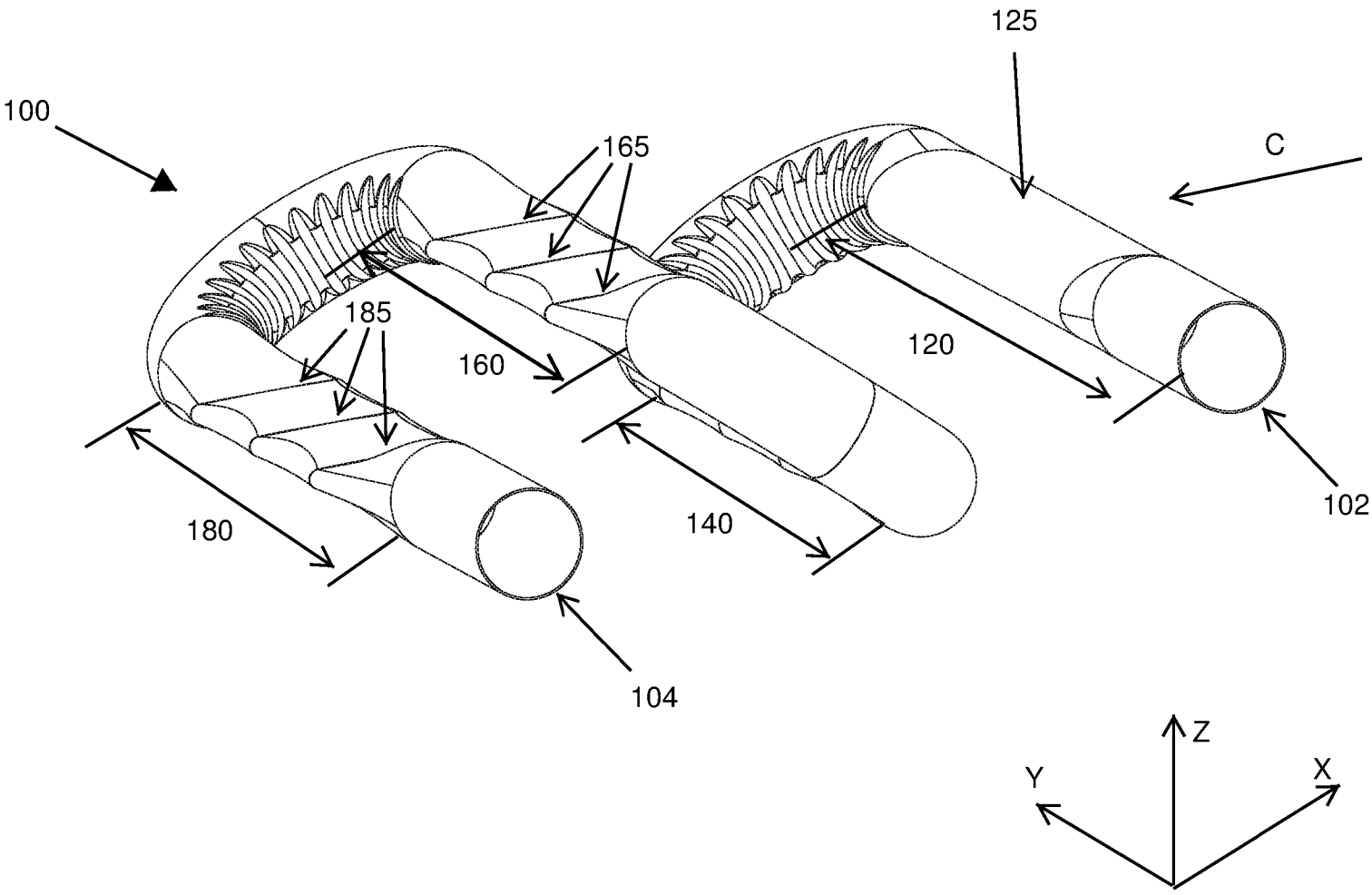
FIG. 3 shows an embodiment of a heat exchanger tube as viewed from an end and side of the heat exchange tube.

An embodiment of a heat exchanger tube 100 is shown in FIG. 2 and FIG. 3. FIGS. 2 and 3 show an embodiment of a heat exchanger tube 100 from different viewpoints. In an embodiment, The heat exchanger tube 100 shown in FIGS. 2 and 3 may be used as the heat exchanger tube 40 in FIG. 1. The heat exchanger tube includes four heat exchange passes 120, 140, 160, 180 that are connected by three connecting bends 190, 192, 194. There are no specific requirements for a heat exchange pass 120, 140, 160, 180 and the configuration of a heat exchange pass depends upon the configuration of a heat exchanger tube 100. A heat exchange pass 120, 140, 160, 180 may have a different length depending upon the heat exchange tube 100. The length of the heat exchange pass 120, 140, 160, 180 being a dimension of the heat exchange pass 120, 140, 160, 180 along the direction of the internal flowing fluid (e.g., combustion gases, fuel and air mixture, etc.). The first heat exchange pass 120 may have a length from the inlet 102 to the start of the bend 190. A fourth heat exchange pass 180 may have a length from the start of the last bend 194 to the end of its outlet 104. Heat exchange passes without an inlet 102 or outlet 104 may have a length from a bend to a bend. For example, the length of the second heat exchange pass 140 would be from the end of the first bend 190 to the start of the second bend 192, and length of the third heat exchange pass 160 would be from the end of the second bend 192 to the start of the third bend 194.

Generally, a heat exchange pass is a length of the heat exchanger tube 100 that crosses at least a portion of a heat exchange volume of a heat exchanger and the length of the heat exchanger tube being configured to transfer heat from the combustion gases to the air. In some embodiments, a heat exchange pass 120, 140, 160, 180 may only pass through a portion of the total width of the heat exchange volume of the heat exchanger. In an embodiment, the width of the heat exchanger may be the distance between the walls forming the heat exchanger volume. In some embodiments, a width of the heat exchanger volume may be the distance between two opposing walls or surfaces of the heat exchanger. For example, the width of the heat exchanger 60 and heat exchanger volume 62 in FIG. 1 may be defined as the distance in the X direction between the walls of the heat exchanger 60 that extend in the Y direction (e.g., the wall of the heat exchanger having the inlet 42 and outlet 44 and the opposing wall, etc.).

Referring to FIGS. 2 and 3, the end of the first heat exchange pass 120 includes an inlet 102 for the heat exchanger tube 100 and the end of the fourth heat exchange pass 180 includes an outlet 104 for the heat exchanger tube 100. In an embodiment, the inlet 102 and outlet 104 are configured to have ends with a circular shape to allow each of the inlet 102 and the outlet 104 to connect to other furnaces models that have circular connectors for the inlet 102 and the outlet 104. It should be understood that other embodiments of a heat exchanger tube may be modified at the end of the inlet 102 and at the end of an outlet 104 if the HVACR has a connector in the shape of the modified length or portion of the first heat exchange pass 120 or the fourth heat exchange pass 180, respectively. In an embodiment, a modifying coupler or connector may also be used in some embodiments to connect such modified ends of a heat exchanger tube 100. The embodiment shown in FIGS. 2 and 3 include four heat exchange passes 120, 140, 160, 180, but other embodiments may include only two or more heat exchange passes. The embodiments of a heat exchanger tube 100 shown and described also include connecting bends 190, 192, 194 having a circular shape, but other embodiments may include one or more of the connecting bends 190, 192, 194 having a cross-sectional shape similar to a heat exchange passage 120, 140, 160, 180. The heat exchanger tube 100 may have connecting bends 190, 192, 194 to fluidly connect each end of the heat exchange pass 120, 140, 160, 180, except for the ends with the input 102 and the output 140.

When the heat exchanger tube 100 is installed, the outside air flows around outside of the heat exchange tube 100 in a direction of the arrow C or the arrow D, such that the air flows around surfaces of the heat exchange passes 120, 140, 160, 180. In a heat exchanger utilizing air and hot combustion gases in a parallel flow configuration, the air may be introduced from a direction shown by the arrow C. For example, the furnace shown in FIG. 1 has a parallel flow configuration. In a heat exchanger utilizing air as a process fluid and hot combustion gases in a counter flow configuration, the air may be blown in the direction shown by arrow D, which is opposite of the direction shown by arrow C.

In operation, a fuel and air mixture flows into the heat exchanger tube 100 through the inlet 102. When flowing into the heat exchanger tube 100, the fuel and air mixture may have already been provided with an ignition source (e.g., the igniter 25, etc.). As the fuel and air mixture has been provided with an ignition source, the combustion of the fuel and air mixture may start before entering the heat exchanger tube 100. The fuel and air mixture may combust and produce heated combustion gases (e.g., carbon dioxide, carbon monoxide, water vapor, or a combination thereof, etc.). In an embodiment, all or at least a majority of the combustion can occur within the first heat exchange pass 120.

As shown in FIGS. 2 and 3, a length of the first heat exchange pass 120 may be modified to form a modified portion 125. The modified portion 125 has a cross-sectional area with a minor diameter and a major diameter. In an embodiment, the modification of the first heat exchange pass 120 also does not significantly reduce the cross-sectional area in the modified portion 125. The cross-sectional area of the modified portion 125 may not be reduced for a variety of reasons. For example, the cross sectional area of the modified portion may not be reduced to prevent a change in the velocity of the gases flowing through the first heat exchange pass 120. A significant change in velocity may create flame impingement or a negative effect on the upstream mixing of the air and fuel.

A heat exchange pass may be modified in multiple ways. For example, a first heat exchange pass 120 or the heat exchanger tube 100 may be modified by being put into a die mold that forms the modified portion 125. The die may be configured to flatten a circular tube, form dimples, or shape the heat exchange pass 120 and heat exchanger tube 100 in some other manner to form the modified portion 125. It should be noted that the parameter of the modified portion 125 may change when pressed in the die due to the stretching of the metal. The amount of change will depend upon various factors, such as the material composition of the modified portion 125. In an embodiment, the modification of the other heat exchange passes 140, 160, 180 may be formed in a similar manner. Alternatively or additionally, the modification of the heat exchange passes 140, 160, 180 and/or modified portion 125 may be constructed to include the modifications without needing to put the heat exchanger tube 100 or heat exchange passes 120, 140, 160, 180 into a die mold, formation process, or the like.

The modified portion 125 may include the entire first heat exchange pass 120 between the first bend 190 and the open end of the inlet 102. In an embodiment, the modified portion 125 may not be consistent throughout its entire length as shown in FIGS. 1-3. In an embodiment, the modified portion 125 may have a reduced diameter that is placed near the highest velocity vectors of the air flow caused by the outlet or outlets of the blower. For example in the furnace shown in FIG. 1, the two relatively high velocity vectors may extend in a direction from the arrows labeled A, such that they would each intersect with the first heat exchange pass 52. The modified portion 125 in an embodiment does not have a constant cross-sectional shape along the length of the first heat exchange pass 120. In an embodiment, the modified portion 125 may have at least a minor diameter that changes along the length of the heat exchange pass 120. The shape of the modified heat exchange passes 125 may be modified to include any shape with a cross-section with a non-constant diameter. The non-constant diameter provides the modified heat exchange pass 125 with a minor diameter and a major diameter. For example, various embodiments of heat exchanger tube may include one or more modified heat exchange passes having the cross-sectional shape of an ellipse, an oval, a lens, a rectangle, a teardrop shape, a cardioid, a parallelogram, etc.

Figure 4:
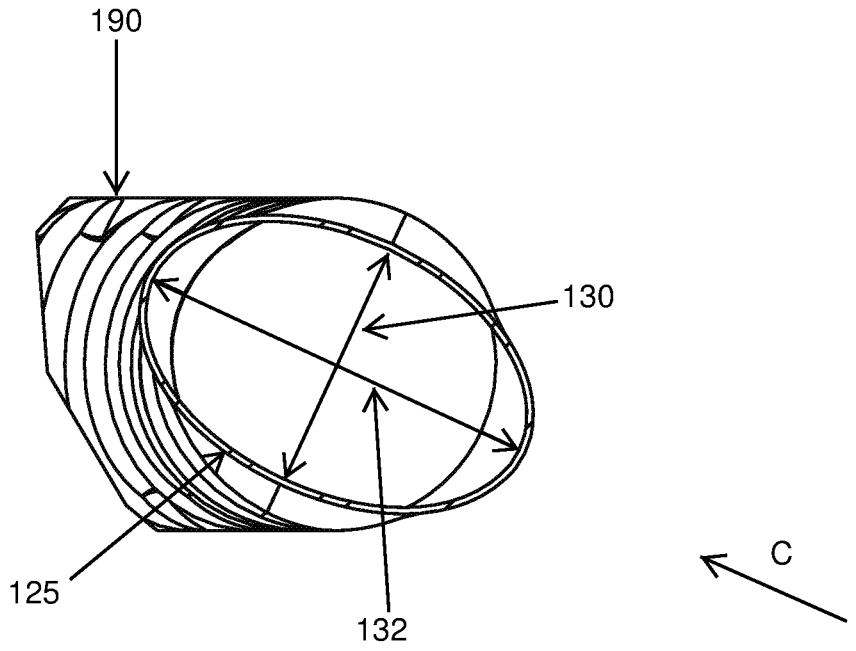
FIG. 4 shows a cross-section of an embodiment of a heat exchanger tube from the viewpoint E-E shown FIG. 2.

FIG. 4 shows a cross-section of the first heat exchange pass 120 from the viewpoint E-E shown in FIG. 3. As previously described, a length of the first heat exchange pass 120 has been modified such that its shape has a major axis (e.g., diameter) 132 and a minor axis (e.g., diameter) 130. The major diameter 132 corresponds to the largest diameter in a cross-section of the modified portion 125 of the first heat exchange pass 120. In an embodiment, the minor diameter 130 corresponds to the smallest diameter in a cross-section of the modified portion 125 of the first heat exchange pass 120. The reduction of the minor diameter 130 may be compared to the original diameter of a circular heat exchange tube. For example, the original diameter may be diameter of the inlet 102, the diameter of the outlet 104, or the diameter of a heat exchanger tube without the described modifications such as those previously used for the first heat exchange pass 120. The minor diameter may be expressed as a reduced diameter percentage:

$$\%\ \text{Reduction of Diameter} = \left(1 - \frac{\text{Minor Diameter}}{\text{Original Diameter}}\right) \times 100$$

In an embodiment, reduction of the minor diameter 130 of the modified portion 125 of the first heat exchange pass 120 is at or about 10% to at or about 60%. In an embodiment, the reduction of the minor diameter 130 of the modified portion 125 of the first heat exchange pass 120 is at or about 15% to at or about 45%. In an embodiment, the reduction of the minor diameter 130 of the modified portion 125 of the first heat exchange passage 120 may be at or about 15% to at or about 25%. For example, a first heat exchange pass 120 with an original diameter of 2.0 inches and modified portion 125 having a minor diameter of 1.5 inches would have a first heat exchange pass having a reduced diameter of 25%. In the embodiments shown in FIGS. 2 and 4, the modified portion 125 of the first heat exchange pass 120 may have a minor diameter 130 of at or about 1.40 inches and a major diameter 132 of at or about 2.19 inches. The heat exchanger tube has original diameter of at or about 1.75 inches. Accordingly, the first heat exchange pass 120 would have a reduced minor diameter at or about 20% and a reduced cross-sectional area at or about zero. The design of the modified portion 125 may be largely based on how the reduced minor diameter affects the overall internal pressure drop of the heat exchanger tube 100. As discussed above, the design of the modified portion 125 may also consider how the design affects the combustion of the fuel within the first heat exchange pass 120. In an embodiment, the design of the modification of the first heat exchange pass 120 also considers how subsequent heat exchange passes 140, 160, 180 and their modifications may contribute to the overall internal pressure drop of the heat exchanger tube 100. In an embodiment, The amount of reduction of the minor diameter in a modified portion 125 and in the subsequent heat exchange passes 140, 160, 180 is based upon how much of an affect the reduction has on the internal pressure drop of the entire heat exchanger tube 100.

Experimental computerized fluid dynamics have shown that an embodiment of a first heat exchange pass 120 with a modified portion 125 that has a reduced minor diameter 130 at or about 20% has been shown to reduce the external pressure drop over the first heat exchange pass 120 by approximately 60% while increasing the internal pressure drop of the first heat exchange pass 120 by approximately 60% or at or about 0.001 inches of H2O per 15 inches of the modified portion 125 with an original diameter of 1.75 inches. Furthermore, an embodiment of a first heat exchange pass with a modified portion 125 that has a reduced diameter 130 at or about 40% has been shown to reduce the external drop by approximately 85% while increasing the internal pressure drop of the first heat exchange pass by approximately 250% or at or about 0.003 inches of H2O per 15 inches of the modified portion 125 with an original diameter of 1.75 inch. Furthermore, an embodiment of a first heat exchange pass 120 with a modified portion 125 that has a reduced minor diameter 130 at or about 60% has been shown to reduce the external pressure drop across the first heat exchange pass 120 by approximately 95% while increasing the internal pressure drop of the first heat exchange pass 120 by approximately 1000% or at or about 0.0183 inches of H2O per 15 inches of the modified portion 125 with an original diameter of 1.75 inches. Furthermore, an embodiment of a first heat exchange pass 120 with a modified portion 125 that has a reduced minor diameter 130 at or about 70% has been shown to reduce the external pressure drop across the first heat exchange pass 120 by approximately 95% while increasing the internal pressure drop of the first heat exchange pass 120 by approximately 9000% or 0.158 inches of H2O per 15 inches of modified portion 125 with an original diameter of 1.75 inches. Furthermore, an embodiment of the first heat exchange pass 120 with a modified portion 125 that has a reduced diameter of at or about 80% has been shown to reduce the external pressure drop across the first heat exchange pass by approximately 97% while increasing the internal pressure drop of the first heat exchange pass 120 by approximately at or about 40,000% or 0.75 inches of H2O per 15 inches of the modified portion 125 with an original diameter of 1.75 inches. The percentage increase of the internal pressure drop in some embodiments is large because the round heat exchange pass provides a very low pressure drop.

As shown in FIG. 4, the modified portion 125 of the heat exchange pass 120 may be angled such that its major axis is orientated in a direction of the incoming air such that the modified portion 125 of the first heat exchange pass 120 presents a streamlined shape for the incoming air to flow over. As described below regarding FIG. 5, the major axis or a major diameter of the modified portion 125 does not have to be oriented in a direction that is exactly parallel with the direction of the incoming airflow in some embodiments.

The other subsequent heat exchange passes 140, 160, 180 may have a circular cross-sectional shape with no modifications. Some embodiments may have modification to the subsequent heat exchange passes 140, 160, 180 that are similar to the first heat exchange pass 120. In some embodiments, such as those shown in FIGS. 1-3, 5, 6A, 6B, and 6C, heat exchange passes 140, 160, 180 may have additional modifications to their shape. As the hot combustion gases flow through heat exchanger tube 100, the hot combustion gases cool from heating the external air (through the surface of the heat exchanger tube 100). Accordingly, the heat exchange passes 140, 160, 180 may be provided with a smaller cross sectional area to increase the velocity of the hot combustion gas, which may compensate for the smaller temperature difference between the hot combustion gas and the external air. Additionally, the heat exchange passes 140, 160, 180 may be provided with ribs 145, 165, 185. Each set of ribs 145, 165, 185 may be configured to provide a changing internal minor diameter throughout a length of the heat exchange pass 140, 160, 180. As shown in FIGS. 6A, 6B, and 6C, the minor diameter may change between ribs 145, 165, 185. For example as shown in FIG. 6A, the minor diameter 147 of the second heat exchange pass 140 may be smallest at the ribs 145 and largest at a midpoint 149 between the ribs 145. The ribs 145, 165, 185 provide a structure that mixes the flowing hot combustion gases and prevents the formation of a boundary layer near the internal surface of the heat exchanger tube 100, which occurs with a completely laminar flow. The heat exchange passes 140, 160, 180 are shown as each having three ribs 145, 165, 185, but other embodiments may include one or less than three ribs. Other embodiments may alternatively or additionally employ dimples, non-perpendicular ribs, or other similar surface structures to mix the hot combustion gases within the heat exchanger tube. In an embodiment, other surface structures may be oriented towards the direction of the incoming process fluid.

Figure 5:
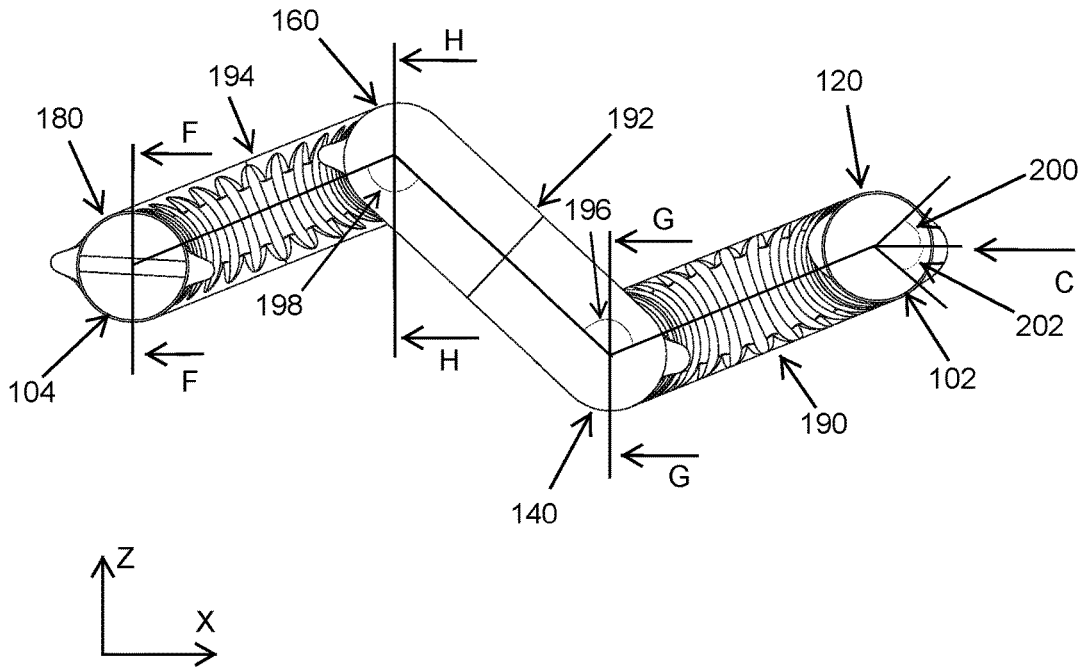
FIG. 5 shows an embodiment of a heat exchanger tube from an end of the heat exchanger tube.
Figure 6A:
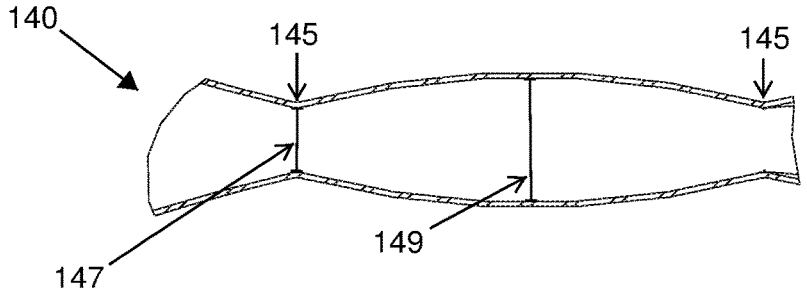
FIG. 6A shows a partial cross-section of an embodiment of a second heat exchange pass from the viewpoint G-G shown in FIG. 5.
Figure 6B:
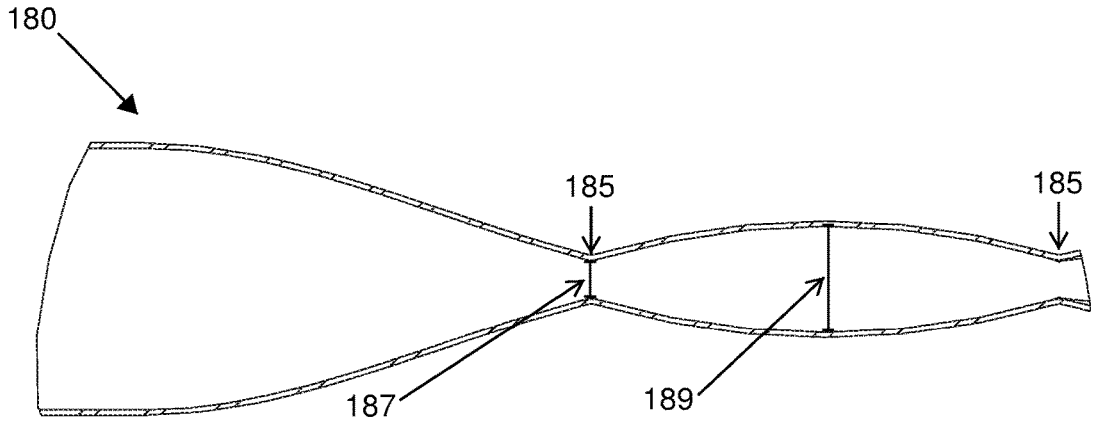
FIG. 6B shows a partial cross-section of an embodiment of a fourth heat exchange pass from the viewpoint F-F shown in FIG. 5.
Figure 6C:
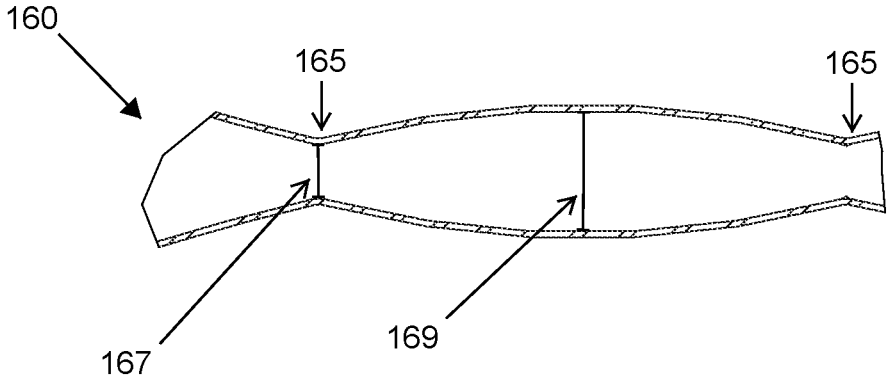
FIG. 6C shows a partial cross-section of an embodiment of a third heat exchange pass from the viewpoint H-H shown in FIG. 5.

FIG. 5 shows an embodiment of a heat exchanger tube 100 from the end of the heat exchanger tube 100 having the inlet 102 and outlet 104. As shown in FIG. 5, the bends 190, 192, 194 may be configured such that the second and third heat exchange passes 140, 160 are located on different planes in the Z direction than the first and fourth heat exchange passes 160, 180. Configuring the heat exchange tube 100 in such a manner allows for the process fluid to flow around the surfaces of the exchanger in a better distribution that allows for a better overall heat exchange between the internal hot combustion gases and the process fluid. The angle between the bends may depend upon one or more of a variety of factors (e.g., configuration of the furnace, configuration of the heat exchange passes 120, 140, 160, 180, etc.). For example, in this embodiment the angle 198 between the second bend 192 and the third bend 194 is at or about 115 degrees. The angle 196 between the first bend 190 and second bend 192 may be the same as the angle 198 between the second bend 192 and the third bend 194, as shown in FIG. 5. Other embodiments may have different angle 196, 198 between the bends.

As shown in FIG. 5, the heat exchanger tube 100 may be configured so that the major axis of each modified heat exchange pass 120, 140, 160, 180 is oriented towards the direction of the incoming air and presents a streamlined shape in the direction of the incoming air. It should be understood that the orientation of the major axis towards a specific direction, such as the direction of an incoming process fluid, may include be understood to include the major axis being oriented in a direction that is not exactly the parallel to the direction of the process fluid. In an embodiment, the major axis may be oriented at an angle that is up to 42.5 degrees (shown by angles 200 and 202) different than a direction parallel to the incoming process fluid. In an embodiment, the major axis may be oriented at an angle that is up to 44 degrees different than a direction parallel to direction of the incoming process fluid. In an embodiment, the major axis may be oriented at an angle that is up to 41 degrees different that a direction parallel to the direction of incoming process fluid.

FIGS. 6A, 6B, and 6C show partial cross-sections of the second heat exchange pass 140, third heat exchange pass 160, and fourth heat exchange pass 180, respectively, of the heat exchanger tube 100 shown in the embodiment in FIG. 5. FIG. 6A shows a partial cross-section of the second heat exchange pass 140 of an embodiment of a heat exchanger tube 100 from the viewpoint F-F shown in FIG. 5. FIG. 6B shows a partial cross-section of the fourth heat exchange pass 180 of an embodiment of a heat exchanger tube 100 from viewpoint G-G shown in FIG. 5. FIG. 6C shows a partial cross-section of the third heat exchange pass 160 of an embodiment of a heat exchanger tube 100 from viewpoint H-H shown in FIG. 5. The heat exchange passes 140, 160, 180 not intended for the majority of a combustion reaction may include ribs 145, 165, 185. In an embodiment, the internal minor diameter of each heat exchange pass 140, 160, 180 is not constant along its length. In an embodiment a heat exchange pass 140, 180 may have its smallest minor diameter 147, 167, 187 at the ribs 145, 165, 185 and a larger minor diameter 149, 169, 189 at a midpoint between ribs 145, 165, 185. Embodiments of a heat exchange pass 100 may employ heat exchange passes 140, 160, 180 each having a reduced minor diameter 147, 167, 187 at or about 5% to at or about 95%. The reduction of a minor diameter 147, 167, 187 may be based upon the original diameter as described above for the modified portion 125 of the first heat exchange pass 120. Some embodiments may be configured so that the opposing ribs touch (100% reduced minor diameter). An embodiment may utilize a reduced diameter of 147, 167, 187 that is at least 15% reduced. An embodiment may utilize a reduced diameter 147, 167, 187 that is at least 25% reduced. An embodiment may utilize a reduced diameter 147, 167, 187 that is at least 50% reduced.

Embodiments of a heat exchange pass 140, 160, 180 having a reduced minor diameter may also have a corresponding reduced cross-sectional area. Embodiments may utilize a reduced minor diameter 147, 167, 187 and major diameter such that the reduced cross-sectional area of the heat exchange pass 147, 167, 187 is at least 5% reduced. An embodiment may utilize a reduced minor diameter of 147, 167, 187 and major diameter such that the reduced cross-sectional area of the minor diameter 147, 167, 187 is at least 50% reduced. An embodiment may utilize a reduced minor diameter of 147, 167, 187 and major diameter such that the reduced cross-sectional area of the minor diameter 147, 167, 187 is at least 85% reduced. An embodiment may utilize a reduced minor diameter of 147, 167, 187 and major diameter such that the reduced cross-sectional area of the minor diameter 147, 167, 187 is at least 95% reduced.

For example, the second heat exchange pass 140 shown in FIG. 6A may include a minor diameter 147 at the ribs 145 at or about 0.42 inches and a major diameter at or about 2.42 inches; the original diameter may be at or about 1.75 inches. Accordingly, the second heat exchange pass 140 would have a reduced minor diameter of at or about 77% and a reduced cross-sectional area at or about 67%. In such an example, the fourth heat exchange pass 180 shown in FIG. 6B may have for example a minor diameter 187 at the ribs 185 of 0.25 inches and a major diameter of 2.44 inches. Accordingly, the fourth heat exchange passage 180 would have a reduced minor diameter at or about 86% and reduced cross section area of at or about 80%. In some embodiments the reduction of all the heat exchange passes 120, 140, 160, 180 may be the same. However, as described above the amount of heat transferred by the internal combustion gasses reduces as the gas travels through the heat exchange tube 100. As such, many embodiments will utilize a greater reduction for each subsequent heat exchange pass to overcome the loss of total heat transfer due to the hot combustion gasses cooling. For example, in an embodiment, the minor diameter 130 of the first heat exchange pass 120 may be at or about 20% reduced, the minor diameter 147 of a second heat exchange pass 140 may be at or about 35% reduced, a minor diameter 167 of the third heat exchange pass 160 may be at or about 55% reduced, and a minor diameter 187 of a fourth heat exchange pass 180 may be at or about 70% reduced. For example, in an embodiment, a cross sectional area of the first heat exchange pass 120 may not be reduced, a cross sectional area of the second heat exchange pass 140 may be at or about 20% reduced, a cross sectional area of the third heat exchange 160 pass may be at or about 60% reduced, and a cross sectional area of the fourth heat exchange pass 180 may be at or about 75% reduced.

The third heat exchange pass 160 in an embodiment may be configured similar to the fourth heat exchange pass 180 as described above such that the reduced minor diameter 167 of the third heat exchange pass 160 is configured to be the same as the fourth heat exchange pass 180. Alternatively and as shown in FIG. 6C, the third heat exchange pass 160 may be configured to have a minor diameter 167, cross-sectional area, or both that is between the minor diameters 147, 187 and cross-sectional areas of the second heat exchange pass 140 and the fourth heat exchange pass 180 as the temperature of the hot combustion gas in the third heat exchange pass 160 would be in between the temperatures of the hot combustion gas in the fourth heat exchange pass 180 and second heat exchange pass 160. The heat exchange passes 140, 160, 180 are described as having a single reduced minor diameter 147, 167, 187 for all of the ribs 145, 165, 185, but other embodiments may have one or more ribs 145, 165, 185 having different reduced minor diameters 147, 167, 187. For example, an embodiment of a heat exchanger tube 100 may have the minor diameter 147, 167, 187 of each rib 145, 165, 185 along the length of heat exchanger tube 100 being more reduced so as to compensate the progressively colder gas with an increased velocity.

As previously discussed, some embodiments may not have a circular inlet 102, in such embodiments the first heat exchange pass 120 may extend from the inlet 102 to the first bend 190. The heat exchanger tube 100 may be configured such that major diameter of the first heat exchange pass 120 may be directed in a direction facing the incoming air to be heated. When configured as such, the heat exchanger tube 100 has a streamlined shape as the air flows around the outside surface of each heat exchange passes 180, 160, 140, 120. In a heat exchanger having a parallel flow configuration, the first heat exchange pass 120 having a modified portion 125 can greatly reduce the amount of power required by a fan (e.g., blower 30 in FIG. 1, etc.) to blow air past the heat exchanger tube 100 without a significant increase in the internal pressure drop through the length heat exchanger tube 120 or significant drop in the rate of heat exchanged to the external fluid.

Aspects:

Any of aspects 1-9 can be combined with any of aspects 10-20 and any of aspects 10-18 can be combined with aspect 19-20.

Aspect 1. A heat exchanger tube, comprising:

a first heat exchange pass including an inlet and being configured as a combustion pass;

one or more subsequent heat exchange passes, one of the one or more subsequent heat exchange passes including an tube outlet;

one or more bends that fluidly connect the heat exchange passes, wherein the first heat exchange pass includes a modified portion, the modified portion shaped such that it has a minor diameter and a major diameter.

Aspect 2. The heat exchanger tube of aspect 1, wherein the minor diameter of the modified portion of the first heat exchange pass has a reduced diameter at or about 10% to at or about 60%.

Aspect 3. The heat exchanger tube of aspect 1, wherein the minor diameter of the modified portion of the first heat exchange pass has a reduced diameter at or about 15% to at or about 25%.

Aspect 4. The heat exchanger tube of any of aspect 1-3, wherein the one or more subsequent heat exchange passes includes a second heat exchange pass, the second heat exchange pass includes a modified portion having a minor diameter and a major diameter and one or more surface features configured to disrupt an internal boundary layer, the minor diameter of the modified portion of the second heat exchanger pass has a reduced diameter at or about 5% to at or about 100%.

Aspect 5. The heat exchanger tube of any of aspects 1-4, wherein a cross-sectional area of the modified portion of the second heat exchange pass has a reduced cross-sectional area of at least 25%.

Aspect 6. The heat exchanger tube of any of aspects 1-5, wherein the one or more subsequent heat exchange passes includes a third heat exchange pass, the third heat exchange pass includes a modified portion having a minor diameter and a major diameter and one or more surface features configured to disrupt an internal boundary layer, the minor diameter of the modified portion of the third heat exchange pass has a reduced diameter at or about 5% to at or about 100%.

Aspect 7. The heat exchanger tube of any of aspects 1-6, wherein each of a cross-sectional area of the modified portion of the second heat exchange pass and a cross-sectional area of the modified portion of the third heat exchange pass have a reduced cross-sectional area of least 25%.

Aspect 8. The heat exchanger tube of any of aspects 1-7, wherein the minor diameter of the second heat exchange pass is less than the minor diameter of the third heat exchange pass.

Aspect 9. The heat exchanger tube of any of aspects 1-8, wherein a cross-section of the modified portion of the first heat exchange pass has a shape of an ellipse.

Aspect 10. A HVACR system for heating air, comprising:

a heat exchanger volume for heating air;

a heat exchanger tube including a first heat exchange pass and a second heat exchange pass, the heat exchanger tube being located within the heat exchanger volume; and a blower that blows outer air into the heat exchange volume towards the heat exchanger tube, wherein a first heat exchanger pass is a combustion pass, and the first heat exchange pass includes an inlet and a modified portion, the modified portion having a major diameter and a minor diameter, and the heat exchanger tube being configured such that the major diameter of the first heat exchange pass is oriented towards an incoming direction of the blowing air.

Aspect 11. The HVACR system of aspect 10, wherein the minor diameter of the modified portion of the first heat exchange pass has a reduced diameter at or about 10% to at or about 60%.

Aspect 12. The HVACR system of either of the aspects 10, wherein the minor diameter of the modified portion of the first heat exchange pass has a reduced diameter at or about 15% to at or about 25%.

Aspect 13. The HVACR system of any of the aspects 10-12, further comprising:

An air outlet for air to leave the heat exchanger volume, wherein the blower, a vent, and the heat exchange volume are configured so that the air flows through the heat exchange volume in a direction perpendicular to a length direction of the heat exchange passes of the heat exchanger tube.

Aspect 14. The HVACR system of any of the aspects 10-13, wherein the second heat exchange pass includes a modified portion having a minor diameter and a major diameter, and the second heat exchange pass being configured such that the major diameter of the modified portion of the second heat exchange pass is oriented towards an incoming direction of the outer air.

Aspect 15. The HVACR system of any of the aspects 10-14, wherein the heat exchanger tube includes a third heat exchange pass, the third heat exchange pass includes a modified portion having a minor diameter and a major diameter, and the third heat exchanger pass being configured such that the major diameter of the modified portion of the second heat exchange pass is oriented towards an incoming direction of the outer air.

Aspect 16. The HVACR system of any of the aspects 10-15, wherein each of a cross-sectional area of the modified portion of the second heat exchange pass and a cross-sectional area of the modified portion of the third heat exchange pass has a reduced cross-sectional area of at least 25%.

Aspect 17. The HVACR system of any of the aspects 15-16, wherein the minor diameter of the modified portion of the second heat exchange pass has a reduced diameter at or about 5% to at or about 100% and the minor diameter of the modified portion of the third heat exchanger pass has a reduced diameter at or about 5% to at or about 95%, and the minor diameter of the modified portion of the second heat exchange pass is less than the minor diameter of the modified portion of the second heat exchange pass.

Aspect 18. The HVACR system of any of the aspects 15-17, wherein the second heat exchange pass includes one or more ribs to disrupt an internal boundary layer of the second heat exchange pass, and the third heat exchange pass includes one or more ribs to disrupt an internal boundary layer of the third heat exchange pass.

Aspect 19. A method of making a heat exchanger, comprising:

constructing heat exchanger housing with a heat exchanger volume;

positioning a heat exchanger tube in the heat exchanger volume, the heat exchanger tube including at least a first heat exchange pass having a modified portion with a major diameter and a second heat exchange pass, and the first heat exchange pass being configured as a combustion pass;

providing a burner at a tube inlet of the heat exchanger tube, such that when the heat exchanger is in operation, the burner supplies at least a fuel into the first heat exchange pass and the fuel at least partially combusts in the first heat exchange pass;

providing an inlet and outlet for a process fluid such that, when the heat exchanger is in operation, the process fluid flows through the heat exchanger volume and past the heat exchanger tube;

configuring the first heat exchange pass such that the major diameter of modified portion of the first heat exchange pass is oriented towards an incoming direction of the process fluid.

Aspect 20. The method of making a heat exchanger of the aspect 19, wherein the first heat exchanger tube includes a minor diameter having a reduced diameter at or about 10% to at or about 60%.

The examples and embodiments disclosed in this application are to be considered in all respects as illustrative and not limitative. The scope of the invention is indicated by the appended claims rather than by the foregoing description; and all changes which come within the meaning and range of equivalency of the claims are intended to be embraced therein.

What is claimed is:

1. A heat exchanger tube, comprising:

a first heat exchange pass including an inlet and being configured as a combustion pass;

one or more subsequent heat exchange passes, one of the one or more subsequent heat exchange passes including an outlet;

one or more bends that fluidly connect two of the heat exchange passes, wherein the first heat exchange pass has a length extending from the inlet to a first one of the one or more bends, a majority of the length of the first heat exchange pass being modified to form a modified portion that includes a minor diameter and a major diameter, a cross-sectional area of the heat exchanger tube at the minor diameter and the major diameter being at or about the same area as a circular cross-sectional area that has a single diameter based on equally increasing and reducing the minor diameter and the major diameter, respectively.

2. The heat exchanger tube of claim 1, wherein the minor diameter of the modified portion of the first heat exchange pass has a reduced diameter at or about 10% to at or about 60%.

3. The heat exchanger tube of claim 1, wherein the minor diameter of the modified portion of the first heat exchange pass has a reduced diameter at or about 15% to at or about 25%.

4. The heat exchanger tube of claim 1, wherein the one or more subsequent heat exchange passes includes a second heat exchange pass, the second heat exchange pass includes a modified portion having a minor diameter and a major diameter and one or more surface features configured to disrupt an internal boundary layer, the minor diameter of the modified portion of the second heat exchanger pass has a reduced diameter at or about 5% to at or about 100%.

5. The heat exchanger tube of claim 4, wherein a cross-sectional area of the modified portion of the second heat exchange pass has a reduced cross-sectional area of at least 25%.

6. The heat exchanger tube of claim 4, wherein the one or more subsequent heat exchange passes includes a third heat exchange pass, the third heat exchange pass includes a modified portion having a minor diameter and a major diameter and one or more surface features configured to disrupt an internal boundary layer, the minor diameter of the modified portion of the third heat exchange pass has a reduced diameter at or about 5% to at about or about 100%.

7. The heat exchanger tube of claim 6, wherein each of a cross-sectional area of the modified portion of the second heat exchange pass and a cross-sectional area of the modified portion of the third heat exchange pass have a reduced cross-sectional area of least 25%.

8. The heat exchanger tube of claim 6, wherein the minor diameter of the third heat exchange pass is less than the minor diameter of the second heat exchange pass.

9. The heat exchanger tube of claim 1, wherein a cross-section of the modified portion of the first heat exchange pass has a shape of an ellipse.

10. A HVACR system for heating air, comprising:

a heat exchanger volume for heating air;

a heat exchanger tube including a first heat exchange pass, a second heat exchange pass, and a bend fluidly connecting the first heat exchange pass to the second heat exchange pass, the heat exchanger tube being located within the heat exchanger volume; and a blower that blows outer air into the heat exchange volume towards the heat exchanger tube, wherein the first heat exchange pass includes an inlet and is a combustion pass, and the first heat exchange pass has a length extending from the inlet to the bend, a majority of the length of the first heat exchange pass being modified to form a modified portion that includes a major diameter and a minor diameter, a cross-sectional area of the heat exchanger tube at the minor diameter and the major diameter being at or about the same area as a circular cross-sectional area that has a single diameter based on equally increasing and reducing the minor diameter and the major diameter, respectively, and the heat exchanger tube being configured such that the major diameter of the first heat exchange pass is oriented towards an incoming direction of the blowing air.

11. The HVACR system of claim 10, wherein the minor diameter of the modified portion of the first heat exchange pass has a reduced diameter at or about 10% to at or about 60%.

12. The HVACR system of claim 10, wherein the minor diameter of the modified portion of the first heat exchange pass has a reduced diameter at or about 15% to at or about 25%.

13. The HVACR system of claim 10, further comprising:

an air outlet for air to leave the heat exchanger volume, wherein the blower, a vent, and the heat exchange volume are configured so that the air flows through the heat exchange volume in a direction perpendicular to the heat exchange passes of the heat exchanger tube.

14. The HVACR system of claim 13, wherein the second heat exchange pass includes a modified portion having a minor diameter and a major diameter, and the second heat exchange pass being configured such that the major diameter of the modified portion of the second heat exchange pass is oriented towards an incoming direction of the outer air.

15. The HVACR system of claim 14, wherein the heat exchanger tube includes a third heat exchange pass, the third heat exchange pass includes a modified portion having a minor diameter and a major diameter, and the third heat exchange pass being configured such that the major diameter of the modified portion of the second heat exchange pass is oriented towards an incoming direction of the outer air.

16. The HVACR system of claim 15, wherein each of a cross-sectional area of the modified portion of the second heat exchange pass and a cross-sectional area of the modified portion of the third heat exchange pass has a reduced cross-sectional area of at least 25%.

17. The HVACR system of claim 16, wherein the minor diameter of the modified portion of the second heat exchange pass has a reduced diameter at or about 5% to at or about 95% and the minor diameter of the modified portion of the third heat exchange pass has a reduced diameter at or about 5% to at or about 95%, and the minor diameter of the modified portion of the third heat exchange pass is less than the minor diameter of the modified portion of the second heat exchange pass.

18. The HVACR system of claim 15, wherein the second heat exchange pass includes one or more ribs to disrupt an internal boundary layer of the second heat exchange pass, and the third heat exchange pass includes one or more ribs to disrupt an internal boundary layer of the third heat exchange pass.

19. A method of making a heat exchanger, comprising:

constructing a heat exchanger housing with a heat exchanger volume;

positioning a heat exchanger tube in the heat exchanger volume, the heat exchanger tube including a first heat exchange pass, a second heat exchange pass, and a bend fluidly connecting the first heat exchange pass to the second heat exchange pass, the first heat exchange pass including an inlet and is configured as a combustion pass, the first heat exchange pass having a length extending from the inlet to the bend, a majority of the length of the first heat exchange pass being modified to form a modified portion that includes a major diameter and a minor diameter, a cross-sectional area of the heat exchanger tube at the minor diameter and the major diameter being at or about the same area as a circular cross-sectional area that has a single diameter based on equally increasing and reducing the minor diameter and the major diameter, respectively;

providing a burner at a tube inlet of the heat exchanger tube, such that when the heat exchanger is in operation, the burner supplies at least a fuel into the first heat exchange pass and the fuel at least partially combusts in the first heat exchange pass;

providing an inlet and an outlet in the heat exchanger housing for a process fluid such that, when the heat exchanger is in operation, the process fluid flows through the heat exchanger volume and past the heat exchanger tube; and configuring the first heat exchange pass such that the major diameter of modified portion of the first heat exchange pass is oriented towards an incoming direction of the process fluid.

20. The method of making a heat exchanger of claim 19, wherein the minor diameter of the modified portion of the first heat exchange pass has a reduced diameter at or about 10% to at or about 60%.

* * * * *